US008983782B2

(12) United States Patent
Speck

(10) Patent No.: US 8,983,782 B2
(45) Date of Patent: Mar. 17, 2015

(54) MAGNETIC BEACON GUIDANCE SYSTEM

(76) Inventor: Neil Speck, Clontarf (AU)

( * ) Notice: Subject to any disclaimer, the term of this patent is extended or adjusted under 35 U.S.C. 154(b) by 1248 days.

(21) Appl. No.: 12/087,324

(22) PCT Filed: Dec. 29, 2005

(86) PCT No.: PCT/AU2005/001964

§ 371 (c)(1),
(2), (4) Date: Jan. 27, 2009

(87) PCT Pub. No.: WO2007/073575

PCT Pub. Date: Jul. 5, 2007

(65) Prior Publication Data

US 2009/0222208 A1 Sep. 3, 2009

(51) Int. Cl.

| | |
|---|---|
| ***G01V 1/40*** | (2006.01) |
| ***G01V 3/18*** | (2006.01) |
| ***G01V 5/04*** | (2006.01) |
| ***G01V 9/00*** | (2006.01) |
| ***E21B 25/16*** | (2006.01) |
| ***E21B 47/02*** | (2006.01) |
| ***E21B 47/024*** | (2006.01) |
| ***E21B 7/04*** | (2006.01) |
| ***E21B 47/022*** | (2012.01) |

(52) U.S. Cl.

CPC ..... *E21B 7/046* (2013.01); *E21B 47/024* (2013.01); *E21B 47/02216* (2013.01)

USPC ..... 702/9; 175/45

(58) Field of Classification Search

CPC ..... E21B 7/04; E21B 47/02216

USPC ..... 702/9; 175/45

See application file for complete search history.

(56) References Cited

U.S. PATENT DOCUMENTS

| | | | | |
|---|---|---|---|---|
| 4,710,708 | A * | 12/1987 | Rorden et al. | 324/207.26 |
| 5,485,089 | A * | 1/1996 | Kuckes | 324/346 |
| 5,513,710 | A * | 5/1996 | Kuckes | 175/45 |
| 6,466,020 | B2 * | 10/2002 | Kuckes et al. | 324/326 |
| 6,626,252 | B1 * | 9/2003 | Kuckes | 175/45 |
| 2004/0011149 | A1 * | 1/2004 | Carroll | 73/866.1 |
| 2006/0047428 | A1 * | 3/2006 | Adams | 701/300 |

OTHER PUBLICATIONS

International Search Report and Written Opinion for PCT/AU2005/001964 dated Feb. 9, 2006.

* cited by examiner

*Primary Examiner* — John Breene
*Assistant Examiner* — Manuel Rivera Vargas
(74) *Attorney, Agent, or Firm* — Nelson Mullins Riley & Scarborough, LLP

(57) ABSTRACT

A method of guiding a probe (20) to a target includes placing a magnetic field generator at the target and guiding the probe (20) to a region of the target. The probe carries a survey sensor pack (28) and the method includes using the survey sensor pack (28), firstly, to obtain a plurality of survey readings and, secondly, to obtain a plurality of magnetic beacon readings using a magnetic field generated by the magnetic field generator. A selected number of the survey readings and the magnetic beacon readings are compared and a difference between the survey readings and the magnetic beacon readings is determined. The method includes compensating for that difference thereafter to guide the probe (20) to the target.

33 Claims, 11 Drawing Sheets

MAGNETIC BEACON GUIDANCE SYSTEM

CROSS-REFERENCE TO RELATED APPLICATIONS

This application is the national phase, under 35 U.S.C. §371, of International Application No.: PCT/AU2005/001964, filed Dec. 29, 2005, which designated the United States of America. The present application claims the benefit of priority to and incorporates herein by reference, in its entirety, the disclosure of International Application No.: PCT/AU2005/001964.

FIELD OF THE INVENTION

This invention relates to guidance systems. More particularly, the invention relates to a method of, and a system for, guiding a probe to a target. The invention has particular, but not necessarily exclusive, application in the field of drilling lateral holes to a vertical borehole in the field of coal bed methane gas extraction.

BACKGROUND TO THE INVENTION

In a number of applications, it is necessary to guide a probe to a target through a solid medium. An example of such an application is in the field of coal bed methane gas (CBM) extraction. While the invention has been specifically developed for this application, it could be used in other applications with few, if any, modifications. The invention is therefore not limited to such an application and those skilled in the art will readily appreciate the applicability of the invention to other fields of use.

In one CBM extraction method, a vertical well is drilled from the surface down through the target coal seam. A pump maintains low pressure in a sump cavity below the seam at the bottom of the well. A lateral hole is drilled horizontally through the coal seam with the intention of intersecting the well. The pump is then used to extract methane from the coal seam. The lateral hole enters the ground from a surface location 300 to 1500 meters in horizontal distance up dip from the vent well. Once in the coal seam the drill string is turned to a more horizontal attitude but following the dip of the coal seam. Due primarily to cumulative systematic errors introduced by the measurement systems, an ellipse of uncertainty is created. In effect, there is a very small chance of the lateral hole intersecting the borehole on a first pass of the drill string.

As a result, it a very hit and miss affair to cause the lateral hole to intersect the borehole and, to date, repeated passes of the drill string have been required to achieve this objective. It will be appreciated that it is very costly to operate a drill rig and each pass of the drill string is therefore very costly not to say time-consuming. Each time a further pass of the drill string is required, the drill string needs to be retracted and a new trajectory plotted and drilled.

SUMMARY OF THE INVENTION

According to a first aspect of the invention, there is provided a method of guiding a probe to a target, the method including placing a magnetic field generator at the target;

guiding the probe to a region of the target, the probe carrying a survey sensor pack;

using the survey sensor pack to obtain a plurality of survey readings;

using the survey sensor pack to obtain a plurality of magnetic beacon readings using a magnetic field generated by the magnetic field generator;

comparing a selected number of the survey readings and the magnetic beacon readings and determining a difference between the survey readings and the magnetic beacon readings; and compensating for that difference thereafter to guide the probe to the target.

The difference between the survey readings and the magnetic beacon readings may include an angular difference and/or a displacement difference.

The method may include selecting the magnetic field generator to be of predetermined dimensions. In particular, the method may include selecting the dimensions of the magnetic field generator in dependence of the distance it is estimated the probe is likely to be from the target. Thus, the method may include implementing the magnetic field generator in segments so that a magnetic field generator of desired length can be used.

The method may include initially defining a commencement position and termination position for the probe. In the field of coal bed methane gas extraction, the commencement position of the probe may be a entry collar of a lateral hole to be drilled and the termination position may be the position at which the probe should intersect the target assuming there were no errors.

The method may include processing and recording data generated by the probe along its initial trajectory. Due to the fact that some parts of the trajectory may result in dead ends, the method may include excluding data relating to non-completed, unusable portions of the initial trajectory.

The method may include taking a predetermined number of magnetic beacon readings when the probe is within range of the magnetic field generator. The method may further include deriving fixes from at least two pairs of predetermined magnetic beacon readings. Thus, the method may include selecting each magnetic beacon reading for use in deriving the fixes by comparing the magnetic beacon reading with a corresponding survey reading and, if the magnetic beacon reading differs from the survey reading by an amount exceeding a predetermined value, disregarding that magnetic beacon reading. The method may then include forming a segment of magnetic beacon readings from the fixes. Further, the method may include comparing the segment of magnetic beacon readings with a segment of corresponding survey readings.

Preferably, the method includes taking two measurements for each magnetic beacon reading, one with poles of the magnetic field generator in a first orientation and the other with the poles of the magnetic field generator in an opposite orientation to minimise the effects of earth's magnetic field.

The method may include obtaining a vector representative of a radial component of the magnetic field generated by the magnetic field generator at each magnetic beacon reading. The method may include transforming raw vectors from each magnetic beacon reading to obtain the radial component.

The method may include calculating an angular difference between each magnetic beacon reading and its associated survey reading and calculating a difference in displacement between the magnetic beacon reading and its associated survey reading.

Further, the method may include calculating a new trajectory and displaying the new trajectory to an operator. In particular, the new trajectory may be displayed to the operator both graphically and numerically.

According to a second aspect of the invention there is provided a system for guiding a probe to a target, the system including a magnetic field generator to be located at the target;

a survey probe to be guided to the target, the survey probe carrying a survey sensor pack, sensors of the sensor pack being operable to obtain a plurality of survey readings and a plurality of magnetic beacon readings using a magnetic field generated by the magnetic field generator; and processing equipment for processing data relating to a selected number of the measured survey readings and the magnetic beacon readings to determine a difference between the survey readings and the magnetic beacon readings and for compensating for that difference thereafter to guide the probe to the target.

The magnetic field generator may have variable dimensions, the dimensions of the magnetic field generator being selected in dependence of the distance it is estimated the probe is likely to be from the target. Preferably, the magnetic field generator comprises a plurality of interconnectable segments so that a magnetic field generator of desired length can be used. The magnetic field generator may be a solenoid having switchable poles.

The survey sensor pack may comprise a plurality of magnetometer/accelerometer pairs, the pairs being arranged to take the readings along Cartesian coordinates.

The processing equipment may be operable to process and record data generated by the probe along its initial trajectory.

The survey pack may be operable to take a predetermined number of magnetic beacon readings when the probe is within range of the magnetic field generator. Then, the processing equipment may be operable to derive fixes from at least two pairs of predetermined magnetic beacon readings.

The processing equipment may be operable to select each magnetic beacon reading for use in deriving the fixes by comparing the magnetic beacon reading with a corresponding survey reading and, if the magnetic beacon reading differs from the survey reading by an amount exceeding a predetermined value, disregarding that magnetic beacon reading.

Further, the processing equipment may be operable to form a segment of magnetic beacon readings from the fixes and to compare the segment of magnetic beacon readings with a segment of corresponding survey readings.

The system may include a switching arrangement for switching the relative orientation of poles of the magnetic field generator to minimise the effects of earth's magnetic field.

The processing equipment may be operable to obtain a vector representative of a radial component of the magnetic field generated by the magnetic field generator at each magnetic beacon reading. Thus, the processing equipment may transform raw vectors from each magnetic beacon reading to obtain the radial component.

Further, the processing equipment may be operable to calculate an angular difference between each magnetic beacon reading and its associated survey reading and to calculate a difference in displacement between the magnetic beacon reading and its associated survey reading. From this, the processing equipment may calculate a new trajectory for the probe.

The system may include a display arrangement for displaying the new trajectory of the probe to an operator.

BRIEF DESCRIPTION OF THE DRAWINGS

An embodiment of the invention is now described by way of example with reference to the accompanying diagrammatic drawings in which.

DETAILED DESCRIPTION OF THE EXEMPLARY EMBODIMENT

Figure 1:
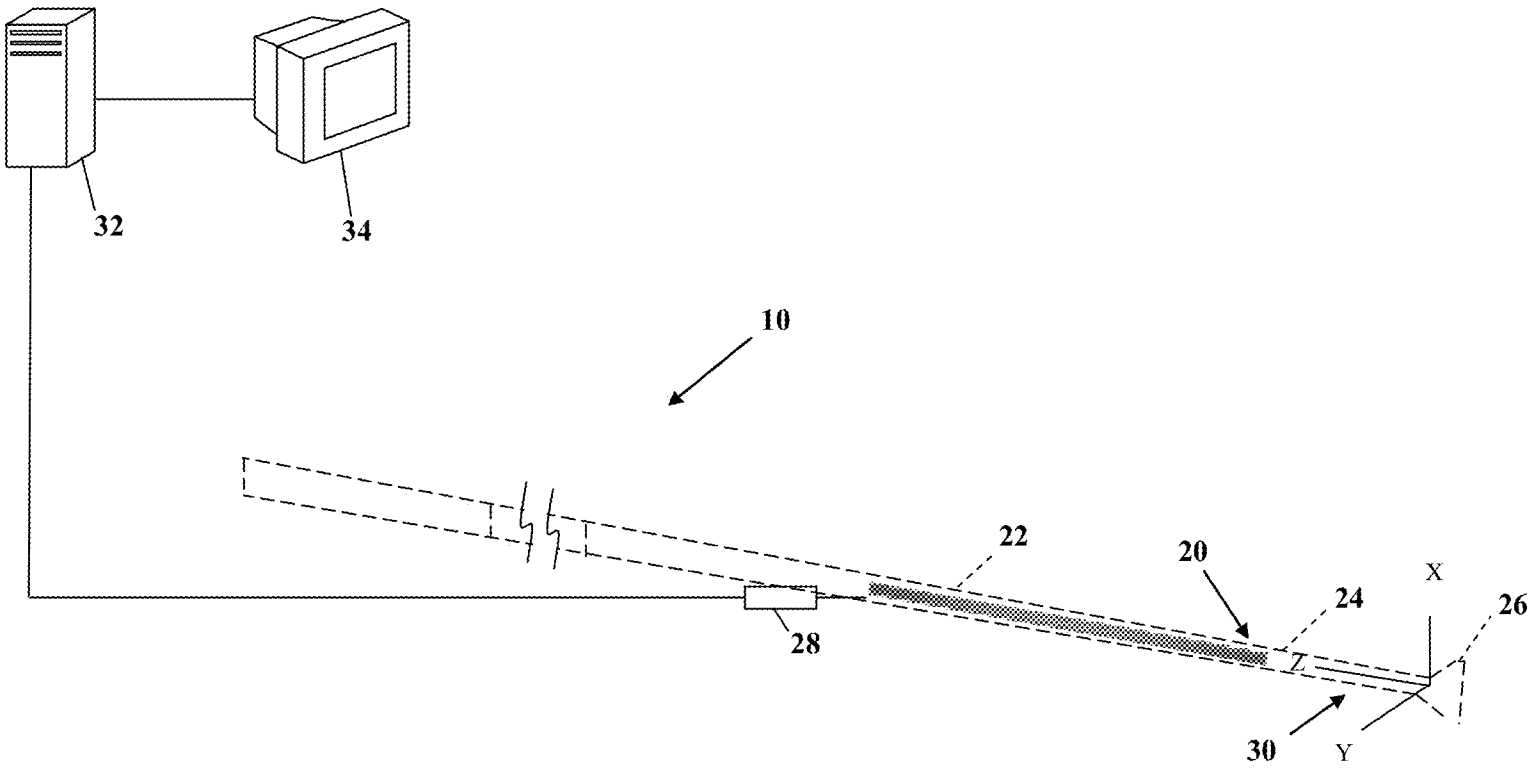
FIG. 1 shows a schematic representation of a system, in accordance with an embodiment of the invention, for guiding a probe to a target.

Referring initially to FIG. 1 of the drawings, an embodiment of a system for guiding a probe to a target is illustrated and is designated generally by the reference numeral 10. The system 10 can be used in numerous applications. However, for ease of explanation only, the system 10 will be described with reference to its application in the field of coal bed methane gas (CBM) extraction from a coal seam.

In such a system, a lateral hole 12 (FIG. 3) is drilled to a target in the form of a vertically extending borehole 14 to intersect the borehole 14. The lateral hole 12 is drilled through a coal seam indicated schematically at 16 in FIG. 6 of the drawings.

Figure 6:
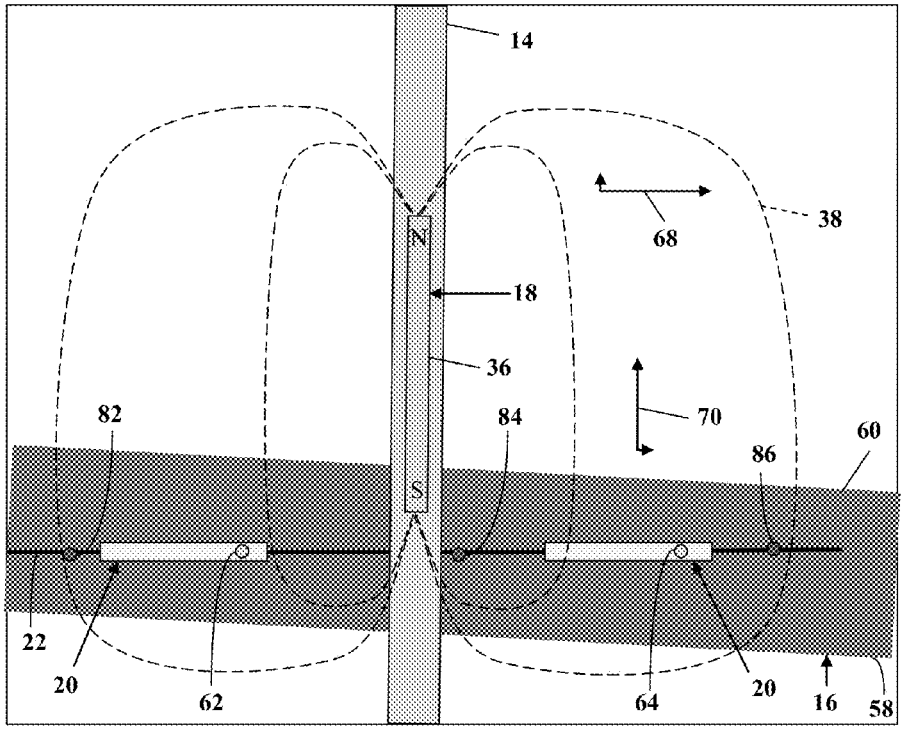
FIG. 6 shows a schematic, sectional side view of the target with a magnetic field generator at the target.

The system 10 incorporates a magnetic field generator or beacon 18 received in the vertical bore hole 14 to be suspended just within the coal seam 16 as illustrated in FIG. 6 of the drawings.

The system 10 further includes a survey probe 20 arranged in a drill string 22. More particularly, the survey probe 20 is arranged in a bottom hole assembly 24 carrying a drill bit 26. The survey probe 20 can be mounted up to 6 to 12 meters rearwardly of the drill bit 26. The survey probe carries a survey sensor pack 28. While the survey sensor pack 28 is shown as a separate component in FIG. 1 of the drawings, this is purely for the sake of illustration. In practice, the survey pack 28 is arranged within the survey probe 20. The survey pack 28 carries a plurality of sensors. The sensors are operable to obtain a plurality of survey readings. More particularly, the sensors comprise three magnetometers and three accelerometers arranged in magnetometer/accelerometer pairs along Cartesian coordinates 30.

The survey probe 20 and, more particularly, its sensor pack 28 communicate with remotely arranged processing equipment in the form of a processor 32. The processor 32 displays data generated on a display 34.

The magnetic beacon 18 may be constituted by any suitable magnetic field generator. In a preferred implementation, the magnetic beacon 18 is in the form of an electromagnet or solenoid 36 which can have its poles switched. It will, however, be appreciated that the magnetic beacon 18 could be a permanent magnet although this would require removing the beacon 18 from the borehole 14 and reversing it in order to reverse its polarity.

The solenoid 36 generates a magnetic field 38. The size and shape of the magnetic field 38 is governed by the length of the solenoid 36. Thus, the solenoid 36 may be arranged in segments which can be secured together in an end-to-end relationship to vary the size and shape of the magnetic field 38 as required.

The lateral hole 12 is dug from an entry position or entry collar 40 (FIG. 2) towards the borehole 14 along a predetermined trajectory 42. The trajectory 42 is plotted relative to a baseline 44.

Due to errors in the sensors of the sensor pack 28 and other factors such as drill string stretch, errors accumulate as the drill string 22 follows the trajectory 42. Thus, although the original trajectory 42 is shown as extending from the entry collar to intersect the target 14, in practice, the trajectory as drilled is more often than not likely to miss the target 14 as shown by the trajectory 46 in FIG. 2 of the drawings. It will be appreciated that the resolution of the sensors in the azimuthal plane is only approximately 0.5°. The entry collar 40 could be up to 1,500 meters away from the target 14 and the target 14 only has a diameter of approximately 15 cm so the likelihood of a trajectory 42 intersecting the target 14 is low.

Figure 2:
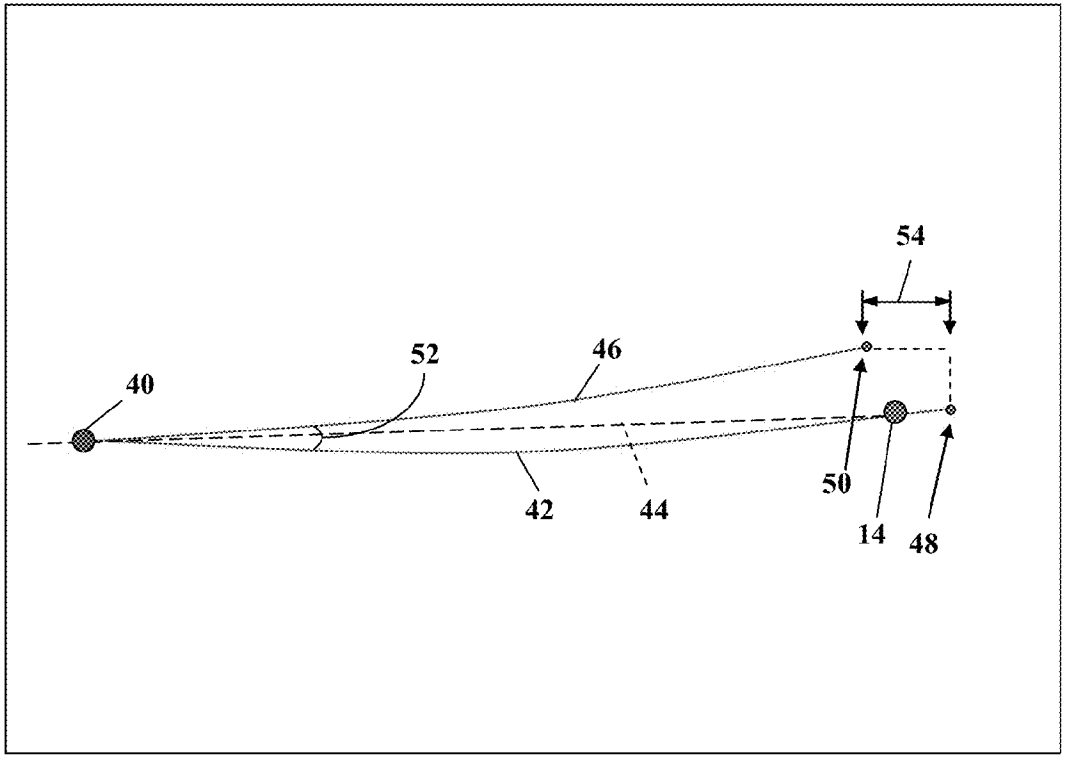
FIG. 2 shows a schematic plot of a comparison between an original trajectory and an adjusted trajectory of a probe of the system of FIG. 1.

In FIG. 2 of the drawings, point 48 indicates the last survey point of the original trajectory and point 50 indicates the last survey point of the adjusted trajectory. This shows azimuthal error 52 as well as a base line displacement error 54.

Figure 3:
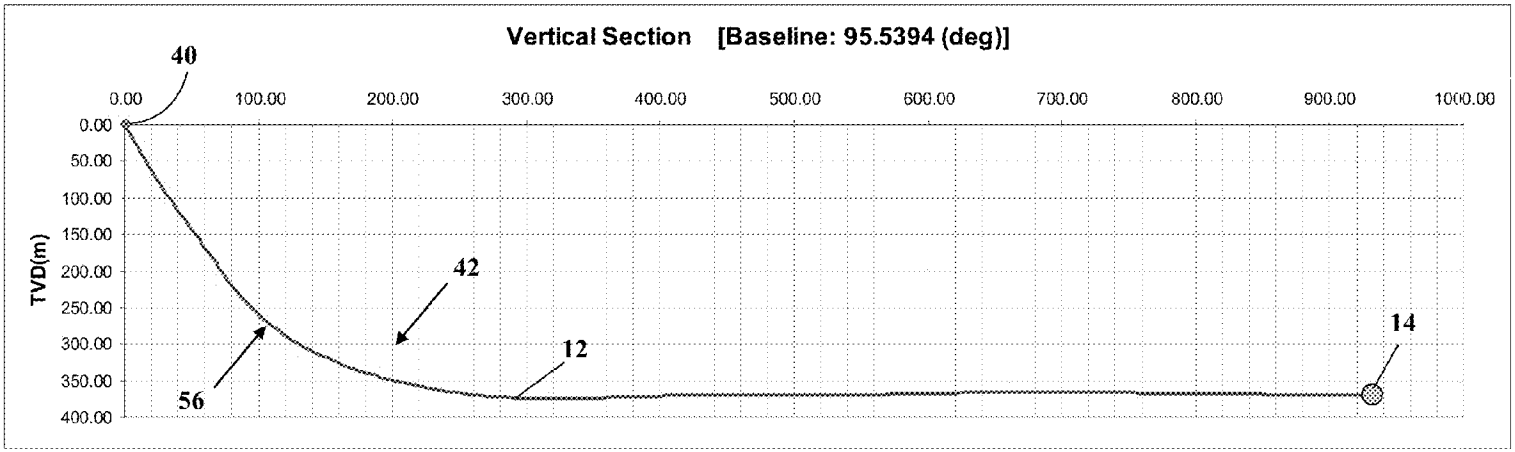
FIG. 3 shows a schematic side view of a path of the probe to the target.

In addition, as shown in FIG. 3 of the drawings, the lateral hole 14, being dug from the surface, must be turned from a few degrees from the vertical towards the horizontal as shown at 56 in FIG. 3 of the drawings. This turning of the lateral hole 12 also introduces significant errors into the trajectory 42.

These errors accumulate over the length of the trajectory 42 and it is necessary to compensate for these errors in order that the target 14 can be intersected by the lateral hole 12.

The entry collar 40 and the target 14 must be accurately defined in grid coordinates before drilling commences as they are important datum points for the operation. Normally the survey calculations resolve position relative to the entry collar 40 so knowing the position of the entry collar 40 in local grid coordinates affects the absolute measurement accuracy of all points along the trajectory 42.

Equally, once a beacon fix has resolved the trajectory's position relative to the target 14 then, assuming that both the position of the entry collar 40 and the position of the target 14 are already well defined, the absolute grid position of the probe 20 at both ends of the trajectory 42 can be determined with a high degree of accuracy.

As an initial step, all data generated from the probe 20 is processed and recorded so that the path of the drill string 22 can be defined within the tolerance limits of the sensors of the sensor pack 28. The path is, however, usually not just a single continuous hole plotted from the entry collar 40 to the target 14. In a typical operation, the process of drilling to the target 14 usually entails drilling a series of branched holes, known as sidetracks, which, when strung together, form the final path. A combination of factors such as faults and rolls in the seam 16 make it very difficult to navigate within a seam floor 58 (FIG. 6) and a seam roof 60 over the distance of the planned trajectory 42. As described above, making navigation even more difficult is the fact that the probe 20 is about 6 m to 12 m back from the bit 26. This, combined with a very constrained turn radius, means the drill string 22 may be unintentionally steered out the coal seam 16 a number of times during any given operation. Each time the seam 16 is exited, the drill string 22 must be withdrawn back into the coal seam 16 where a branch hole can be initiated.

It is a function of the software of the processor 32 of the system 10 to determine the continuous path running from the entry collar 40 to the target 14. Useable portions of the branch holes are included in the final trajectory 42 and interpolated up to their branch points, while unusable dead end sections are excluded.

The processor 32 must obtain all sensor data from the sensor pack 28 of the probe 20 and measured depth interval lengths from the operator or from a sensor attached to the drill string 22. These data are used to resolve position using raw data from the sensor pack 28 of the probe 20. The assumption is made that the trajectory 42 interpolates a circular path between any two surveyed points which has an orientation and radius that is defined by the two point segment. Each segment is calculated using 2×azimuth+2×inclination values Pt1 (az1, inc1)–Pt2 (az2, inc2) plus the measured distance (Δmd) along that segment.

$$(\Delta md = md2 - md1). \qquad \text{Equation 1}$$

Since $\cos(\theta) = \vec{v}\,\mathbf{1} \cdot \vec{v}\,\mathbf{2}$ (dot product of any two vectors)

where θ is the total angular difference between the two vectors being measured.

Then $$\theta = \cos^{-1}(\vec{v}\,1'_{(GCS)} \cdot \vec{v}\,2'_{(GCS)})$$

where $\vec{v}\,\mathbf{1}'_{(GCS)}, \vec{v}\,\mathbf{2}'_{(GCS)}$ are the probe to target unit vectors transformed to the grid coordinate system.

$$f = (2/\theta) * \tan(\theta/2) \text{(bulge factor)} \qquad \text{Equation 2}$$

$$P{\cdot}x = (f * \Delta md/2) * (\sin(\mathrm{Inc}_{(i-1)}) * \sin(Az_{(i-1)}) + (\sin(\mathrm{Inc}_{(i)}) * \sin(Az_{(i)})) \qquad \text{Equation 3}$$

$$P{\cdot}y = (f * \Delta md/2) * (\sin(\mathrm{Inc}_{(i-1)}) * \cos(Az_{(i-1)}) + \sin(\mathrm{Inc}_{(i)} * \cos(Az_{(i)})) \qquad \text{Equation 4}$$

$$P{\cdot}z = (f * \Delta md/2) * \cos(\mathrm{Inc}_{(i-1)}) + \cos(\mathrm{Inc}_{(i)}) \qquad \text{Equation 5}$$

where:

P is the end point of the segment.

Δmd=md2–md1

Inc=inclination

Az=azimuth i=shot sequence index

The measured depth (md) is the total distance measured along the hole 12 relative to the entry collar 40 which is md=0. A trajectory 42 is traced from an accumulating sum of each consecutive point generated from Equations 3 to 5. Thus, $$\text{Trajectory} = \sum_{i=1}^{n} pt_i \qquad \text{Equation 6}$$

where n is the shot number that needs to be resolved and the index i starting from 1 is the sequence number of any point within the set. From Equation 6, it is clear that the trajectory 42 is formed from the accumulating sum of the points calculated from each consecutive pair of measurements taken along the hole 12.

Substituting Equations 3 to 5 for $pt_i$ in Equation 6 gives:

$$\text{Trajectory}.x = \sum_{i=2}^{n} f_{min\ curve}x(Az_{(i-1)}, Az_{(i)}, Inc_{(i-1)}, Inc_{(i)}, md_i - md_{(i-1)}, f) \quad \text{Equation 7}$$

$$\text{Trajectory}.y = \sum_{i=2}^{n} f_{min\ curve}y(Az_{(i-1)}, Az_i, Inc_{(i-1)}, Inc_{(i)}, md_{(i)} - md_{(i-1)}, f) \quad \text{Equation 8}$$

$$\text{Trajectory}.z = \sum_{i=2}^{n} f_{min\ curve}z(Inc_{(i-1)}, Inc_{(i)}, md_{(i)} - md_{(i-1)}, f) \quad \text{Equation 9}$$

An operator of the drill rig 22 uses the results of Equations 7 to 9 to steer along the coal seam 16 to intersect the target 14 eventually. Each point in the trajectory 42 is plotted on a chart that shows the trajectory path 42, entry point at the entry collar 40, target 14 and baseline 44 projected in both plan and vertical section views.

Figure 4:
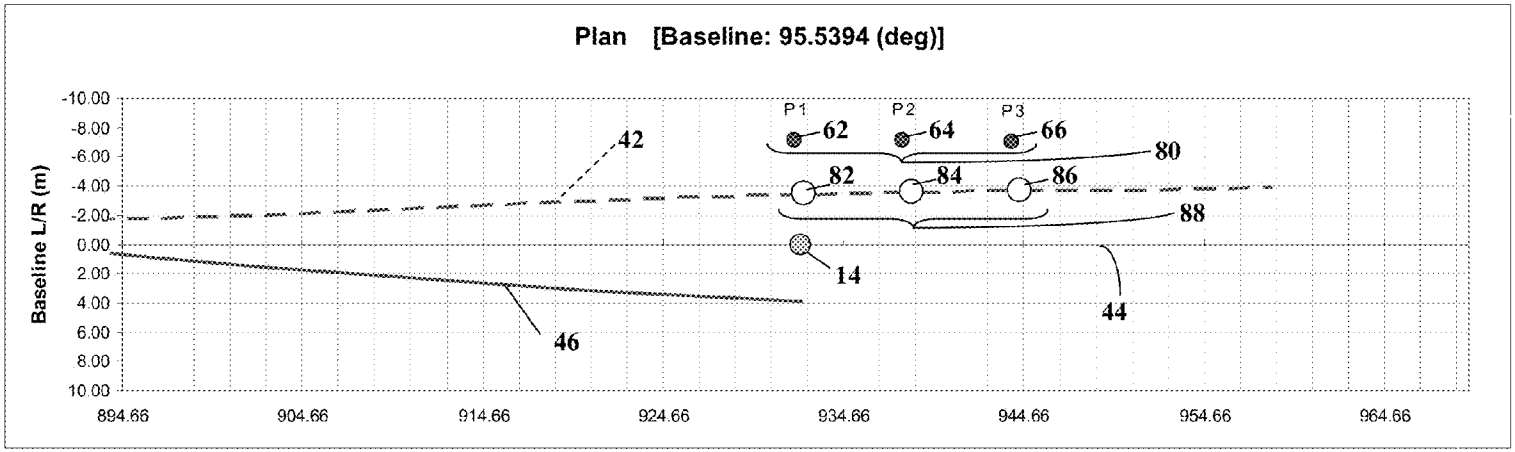
FIG. 4 shows a schematic plan view of the last part of the path of the probe relative to the target indicating a pullback and intersect operation.
Figure 5:
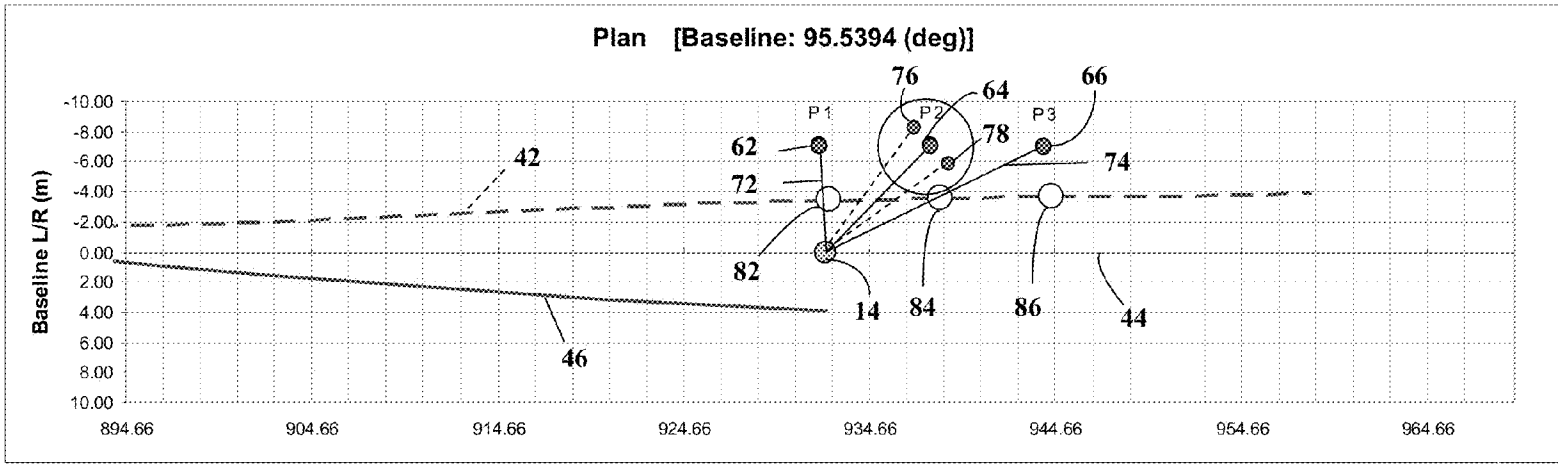
FIG. 5 shows a schematic plan view of the last part of the path of the probe relative to the target indicating a part of a method, in accordance with an embodiment of the invention, for guiding a probe to a target.
Figure 10:
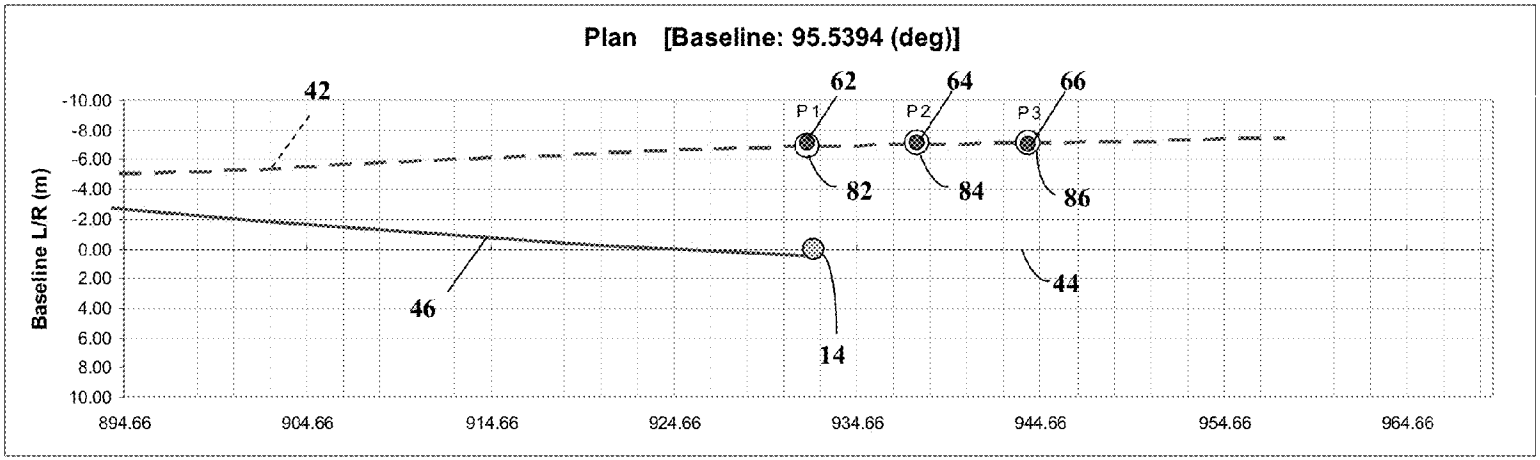
FIG. 10 shows a schematic plan view of the part of the path of FIG. 8 after correction of the trajectory.
Figure 11:
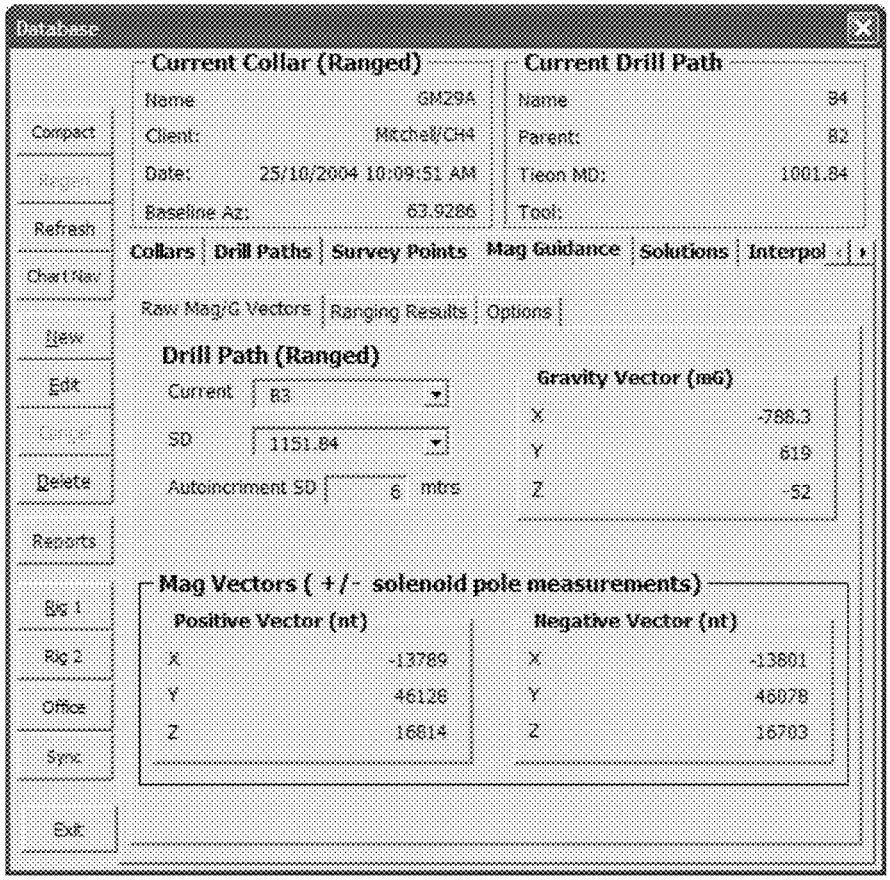
FIG. 11 shows a screen shot of a display of the system of FIG. 1.

To range the target 14 using the beacon 18, the solenoid 36 is first lowered down the vertical target hole 14 so the lower pole is sitting just above the roof 60 of the seam 16. The operator locates the solenoid 36 by performing a cluster of beacon shots out of which there must be at least three good shots 62, 64 and 66 (FIGS. 4, 5 and 10). As will be described in greater detail below, each beacon shot 62, 64 and 66 should produce a large radial vector pointing towards the solenoid. The radial vector is the component of the magnetic field 38 which is perpendicular to the solenoid 36. In this regard, it will be noted that the shape of the magnetic field 38 is largely toroidal and the part of the field having a large radial component lies above and below the solenoid 36 as shown by arrows 68. Conversely, the part of the magnetic field 38 alongside the solenoid 36 has flux lines parallel to the longitudinal axis of the solenoid and, therefore, has a large axial component and a small radial component as indicated by arrows 70.

The extracted radial magnetic field vector acts as a pointer to the solenoid 36. The radial magnetic field vector is obtained by transforming the raw vectors from the sensor pack 28 of the probe 20 as though the probe's coordinate system (the PCS) was oriented to the solenoid 36 and the grid.

Irrespective of the actual orientation of the probe 20, the processor 32 mathematically counter-rotates each sensor output so it measures the field 38 as though the probe 20 were rolled around its axis and inclined so the X sensors of the probe 20 are parallel with the longitudinal axis of the solenoid 36. If the solenoid 36 were perfectly vertical then the X sensor would be pointing straight up indicating 1G, the Y sensor would be horizontal and perpendicular to the horizon therefore showing 0G and the Z axis rotated to north on a grid coordinate system (GCS).

By performing this manipulation, the Y, Z magnetometers (virtually rotated as a result of the transformation) of the sensor pack 28 of the probe 20 will "see" only the radial component 68 of the magnetic field 38 of the solenoid 36 while the virtual X sensor will see only the axial component 70 of the magnetic field 36 of the solenoid 36. Therefore, to find the radial component 68 of the magnetic field 36, the transformation that performs these rotations is applied and Y, Z vectors are obtained. Considering that the horizontal vectors will be rotated to the grid, i.e. the virtual Z axis will be pointing north, then the radial component will be oriented in the GCS in the horizontal plane.

In any set of beacon readings, or shots, 62, 64 and 66 there will be one less fix than the number of shots taken, so for example, the three beacon shots 62, 64 and 66 (obtained from six pole shots) will yield two 2-shot fixes 72, 74 (which is one multi-shot fix) as shown in FIG. 5.

Figure 12:
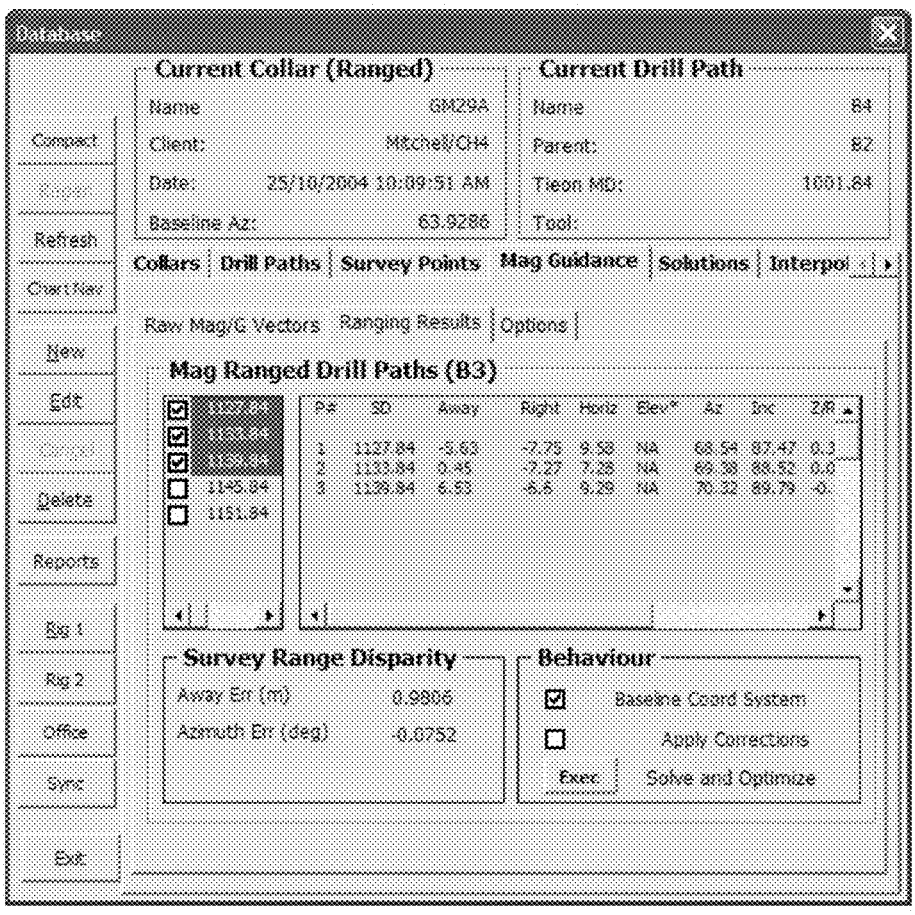
FIG. 12 shows a further screen shot of the display of the system of FIG. 1.

Each fix 72, 74 processes shots in pairs—so fix 1 contains shots 1 and 2, fix 2 contains shots 2 and 3, fix 3 contains shots 3 and 4 etc. The exceptions are the first shot in the first fix and the last shot in the last fix. This means that there are actually 2*(n−1) shots in total, with common points that may not be exactly aligned with each other as shown at 76 and 78 in FIG. 5. The two common points 76 and 78 are averaged so that there are the same number of points as the number of shots taken. Before a point is used however it must pass the misalignment test described below or it is rejected. The misalignment test operates as follows:

- Each segment 80 (FIG. 4) is independently derived and if all measurement data were entirely accurate then each segment would fit seamlessly on to the next without aberration. However, this is usually not the case as the beacon's magnetic field measurements can be noisy—especially if the measured flux density of the radial component of the field is below approx 100 nt. Thus, each vector is checked for contiguous spatial alignment from each shot to the next, i.e. the system ranks the common point between two 2 point fixes in order of the magnitude of their misalignment.
- Any angular deviation between corresponding survey shots (shown, for example, at 82, 84 and 86) and beacon shots greater than 4 deg is considered unacceptable. If this condition exists, then the processor 32 rejects the beacon point that caused the problem. If a point is rejected, then the next pair is used, e.g. if point 3 is rejected from the series s1, s2, s3, s4, fixes f1 (s1, s2), f2 (s2, s4) will remain and then, after averaging the common point s2 $(s2_{(fix1)}+s2_{(fix2)})/2$, the final fix (s1, s2, s4) is obtained.
- Each permutation containing from 3 to 8 shots is then checked for best fit contiguous spatial alignment against the corresponding survey segment 88.
- If found to be within acceptable limits, the survey to beacon shot misalignment distances are averaged for each permutation and contribute to a weighting factor which is used to determine a cluster position in a ranking order. The weighting factor is stored as a single weighted number then enumerated in a list. The list is sorted in order of the least misaligned to the most misaligned (best first-worst last). The processor 32 presents the list to the user as a set of selectable solutions as shown in FIG. 12 of the drawings. However, the system 10 will default to the best solution, i.e. the solution with the least survey to beacon misalignment.

FIG. 5 shows a simple example using the three beacon shots 62, 64 and 66. As described above, there are two fixes 72 and 74 and fixes 1 and 2 produce slightly different displacements 76 and 78. To resolve this, the two displaced shots are averaged and the result is shown as the shot 64. This yields three points which reduces the cluster back to the same number of beacon shots that were actually taken. Although displaced (due to systematic errors), it is to be noted that the segment 80 of beacon shots lines up closely in shape and direction with the segment 88 of survey shots calculated to interpolate the same points.

As described above, the dotted trajectory line 42 represents the beacon ranging run. The points 82, 84 and 86 represent interpolated survey points along the conventionally surveyed trajectory 42 that are at exactly the same measured distance in the hole 12 as each of the beacon points, e.g. points p1, p2 and p3 were ranged when the drill string 22 was at md=1210 m, 1216 m and 1222 m along the hole 12 respectively. Theoretically, the survey shots 82, 84 and 86 should exactly overlie the beacon shots 62, 64 and 66. The fact that they don't means that there are errors. It may be assumed that the errors are in the survey data. The errors are unlikely to be in the beacon shot cluster as they pass the fidelity checks.

The processor 32 could find the coincident survey points by either using a process of interpolation using a minimum curve algorithm to calculate the coordinates of a point that is in between two known points. Another method of obtaining the survey points is by reversing the process of earth field filtering by isolating and using the earth's magnetic field instead of the magnetic field 38 of the solenoid 36.

The processor 32 determines the position in the horizontal plane of the probe 20 with respect to the beacon 18. This is implemented by making magnetic field vector measurements while the solenoid 36 is energized in each pole state as will be described in greater detail below. Accumulated position measurements derived from the survey are compared with the positions derived from beacon. Any deviation component is assumed to be an error and is quantified.

The survey points are calculated using the following equations:

$$G_{(total)}=\sqrt{G_x^2+G_y^2+G_z^2} \quad \text{Equation 10}$$

$$\text{Inc}=\tan^{-1}(G_z/(\sqrt{G_x^2+G_y^2}) \quad \text{Equation 11}$$

$$G_{(roll)}=\tan^{-1}(-G_z/G_x) \quad \text{Equation 12}$$

$$M_{(total)}=\sqrt{M_x^2+M_y^2+M_z^2}$$

$$M_{(Azimuth)}=\tan^{-1}((M_y*G_x-M_x*G_y)/(M_z\cdot G_{(total)}^2-M_x\cdot G_x\cdot G_z-M_y\cdot G_y\cdot G_z-M_z\cdot G_z^2)) \quad \text{Equation 13}$$

$$M_{(dip)}=\tan^{-1}(I/K) \quad \text{Equation 14}$$

with $$I=M_x*G_x+M_y*G_y+M_z*G_z \quad \text{Equation 15}$$

$$J=\alpha_{(total)}\cdot G_{(total)} \quad \text{Equation 16}$$

$$K=\sqrt{J^2-I^2} \quad \text{Equation 17}$$

where $G_{(total)}$=earth gravity.

Inc=Inclination of the survey tool relative to the vertical $G_{(roll)}$=The radial orientation of the probe (number of degrees of rotation around its longitudinal axis). The datum i.e. the high side of the probe is determined by noting the direction of the G vector which is always pointing toward the center of the earth.

$M_{(total)}$=Total magnetic flux density in nano-teslas $M_{(Azimuth)}$0-360 degrees clockwise from magnetic north $M_{(dip)}$=Dip of earth field relative to the horizon There are two kinds of errors that require correction:

Azimuth Error

Azimuth, or horizontal angular, error 52 is the difference in azimuth between the conventional survey segment 88 and the beacon segment 80. Once this error 52 has been determined, the surveyed trajectory 42 can be adjusted by adding the azimuth error to every point in the trajectory 42 or by rotating all points using a geometrical transformation. Azimuth error is in the horizontal plane and manifests as accumulating horizontal position error tracing an arc pivoting around the entry collar. It can be caused from unknowns such as magnetic earth field perturbations, both global and local, sensor misalignments, running gear and rod string interference etc. Because the target is a long vertical formation, it is not necessary to correct for verticality errors. Also, the resolution of the accelerometers of the sensor pack 28 is much higher compared with the magnetometers, typically in the order of +−0.1 deg. This only translates to a meter or so at >1000 m horizontal displacement.

Baseline Displacement Error

Baseline error accumulates along the baseline 44 in a backward or forward direction as shown, for example, at 54 in FIG. 2 of the drawings. Baseline error will have many sources including rod stretch (or rod miscount) but in an operation where the drill hole 12 pitches up from almost vertical to almost horizontal then a very large component will be due to inclination errors accumulating in the vertical to inclined attitude section of the well. This is the catenary section 56 at the beginning of the trajectory 42 in FIG. 3 of the drawings.

To quantify the azimuth error 52 and the baseline displacement error 54, the processor 32, firstly, compares the beacon point cluster with the conventional survey point cluster. To enable this to be done, it is required that the beacon shots 62, 64 and 66 are taken at a known measured depth in the trajectory 42 (typically at a point where the probe 20 communicates to the processor 32 that it is in the field 38 of the solenoid 36). Once a cluster of beacon shots 62, 64 and 66 that pass the misalignment tests have been obtained and the common points normalized, every derived beacon shot is tested against its coincident survey point as defined by their measured depth values. It is to be noted in FIG. 6 of the drawings that only two beacon shots 62 and 64 are illustrated. This is purely for clarity purposes and the processor, in use, requires at least three acceptable (i.e. satisfying the misalignment criteria) to resolve the errors.

$\overrightarrow{BRv}$1,$\overrightarrow{BRv}$2 are the two magnetic beacon's radial unit vectors each associated with their respective measurement points at the time of the fix. $\overrightarrow{BRv}$1,$\overrightarrow{BRv}$2 are unit vectors having a magnitude of one and therefore convey directional information only. Thus, $\overrightarrow{BRv}$1 may be thought of as an arrow pointing toward the beacon 18 at the first location of the fix and $\overrightarrow{BRv}$2 as an arrow also pointing toward the beacon 18 but from the second location.

Each beacon shot consists of two measurements or pole shots. The first measurement is made by the sensor pack 28 of the probe 20 when it is within the magnetic field 38 of the solenoid 36 while the solenoid 36 is energized with a positive (north) pole on the top and negative (south) pole on the bottom. The second measurement is made by the sensor pack 28 of the probe 20 at the same location relative to the solenoid 36 but with the field of the solenoid 36 reversed, i.e. negative (south) pole on top and positive (north) pole on the bottom.

The gravity vector will not fluctuate significantly as the probe 20 is not moved when the measurement procedure is performed at each location (two pole shots are taken at each measurement point to resolve beacon position) so the processor 32 arbitrarily uses the gravity vector from only one of the two pole shots.

If the probe 20 is not moved between shots, then $$\begin{pmatrix} BG_{(i)}.x \\ BG_{(i)}.y \\ BG_{(i)}.z \end{pmatrix} = \begin{pmatrix} G_{(i)}.x \\ G_{(i)}.y \\ G_{(i)}.z \end{pmatrix} \quad \text{Equation 18}$$

BM and BG are raw magnetic and raw gravity vectors, respectively, taken directly from the probe 20. They are raw output from the analogue to digital converters (ADC) of the probe 20. Each ADC serves one of the six orientation sensors in the probe—magnetic (x, y, z) and gravity (x, y, z).

In order to remove the influence of the earth's magnetic field from the measurement, the earth magnetic vector in the second pole shot is subtracted from the earth magnetic vector in the first pole shot. This cancels all unchanged magnetic quantities including earth's magnetic field. Conversely the two switched magnetic field vectors from the beacon 18 will be additive so that the total intensity of the beacon magnetic field vectors will be twice that of a single measurement as shown by Equation 19 below.

$$\begin{pmatrix} BM_{(i)}.x \\ BM_{(i)}.y \\ BM_{(i)}.z \end{pmatrix} = (1/2)\left(\begin{pmatrix} M_{(i)}.x \\ M_{(i)}.y \\ M_{(i)}.z \end{pmatrix} - \begin{pmatrix} M_{(i-1)}.x \\ M_{(i-1)}.y \\ M_{(i-1)}.z \end{pmatrix}\right) \quad \text{Equation 19}$$

Conversely to expose the earth field:

$$\begin{pmatrix} EM_{(i)}.x \\ EM_{(i)}.y \\ EM_{(i)}.z \end{pmatrix} = (1/2)\left(\begin{pmatrix} M_{(i)}.x \\ M_{(i)}.y \\ M_{(i)}.z \end{pmatrix} + \begin{pmatrix} M_{(i-1)}.x \\ M_{(i-1)}.y \\ M_{(i-1)}.z \end{pmatrix}\right) \quad \text{Equation 20}$$

As described above, the system 10 only uses the radial component 68 of the magnetic field 38 of the beacon 18. To extract the radial component 68, the measured field is transformed into the coordinate system of the solenoid 36. To enable this to be done, it is necessary to know the attitude of the solenoid 36 in the borehole 14 in order to be able define a geometric transformation matrix.

The attitude and roll angle of the probe 20 also need to be taken into account. To do so, a 3D transform, S, starting with the attitude of the solenoid 36 needs to be constructed. S could be constructed either using the direction vector of the solenoid 36 or by multiplying two separate rotation matrices (azimuth and inclination of the solenoid 36). For example, one could start with +z axis that is oriented to point positive north. The +z axis is first rotated it around the inclined direction (if it is) of the solenoid 36. Then, the +z axis is rotated again around the Y axis by (INC-90).

To find a transform matrix, T, matrix S must be multiplied by three other matrices being PR (probe roll), PI (probe inclination) and then PA (probe azimuth) to give:

$$T = PR*PI*PA*S \quad \text{Equation 21}$$

where

S is the composite rotation matrix of the solenoid 36 and is the same as T only the roll matrix, PR, is not relevant for the solenoid;

PA is the azimuth rotation matrix of the probe 20;

PI is the inclination rotation matrix of the probe 20; and

PR is the roll rotation matrix of the probe 20.

This rotates the sensor outputs so that the probe's X sensor axis is virtually aligned with the longitudinal axis of the solenoid 36 (which may be vertical). First, the probe 20 must be rotated around its Z axis (rolled) so in effect the Y sensor is pointing horizontally and the X sensor is pointing straight down so gravity is felt only on the X, Z sensors with zero G on the Y axis sensor. Then, the coordinate system should be rotated up by the same amount that the probe is inclined. Finally, the coordinate system should be rotated to grid north. The simplest example would be if the solenoid 36 were vertical and the probe 20 were horizontal (90 deg inclination) with the roll orientation of 0 (oriented toward high side) and moving due north. In that case, T would be an identity matrix.

The orientation vector of the probe 20 would look like PG below if it were rolled to its high side around its Z axis which would make the Y axis of the probe 20 parallel with the horizon and then rotated around its Y axis until Z is also parallel with the horizon. In this configuration, the accelerometers of the sensor pack 28 on the Y and Z axes will read 0 G force and therefore the Y axis accelerometer would read the total 1G.

PG[1 0 0]

It is necessary to transform the vectors from the probe coordinate system (PCS) (also referred to as the sensor coordinate system (SCS)) by rotation using Equations 22 23 below. Points are rotated using Equations 22, 23 and 24 below. Since the calculated heading of the probe 20, is already known, the following general rotation functions can be used:

$$BRv2.y'_{(GCS)} = BRv2.x_{(SCS)}*\sin(Az) + BRv2.y_{(SCS)}*\cos(Az) \quad \text{Equation 22}$$

$$BRv2.x'_{(GCS)} = BRv2.x_{(SCS)}*\cos(Az) - BRv2.y_{(SCS)}*\sin(Az) \quad \text{Equation 23}$$

where Az=Probe 20 Magnetic Heading+Declination

When transforming a segment of two or more points using the above transformations, the first point is translated to the origin and all other points translated equally so $BP1_{(SCS)}$=[0 0] before performing the rotation in Equation 24 below.

$$BPn_{(SCS)} = BPn_{(SCS)} - BP1_{(SCS)} \quad \text{Equation 24}$$

Sometimes it may also require, after performing the transformation, that:

$$BPn_{(SCS)} = BPn_{(SCS)} - BP1_{(SCS)} \quad \text{Equation 25}$$

Figure 9:
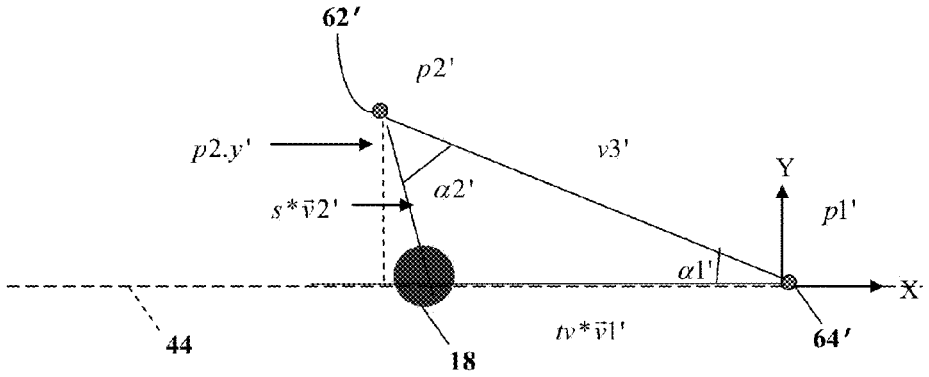
FIG. 9 shows a schematic plan view after transformation of vectors used in the method.

As shown most clearly in FIG. 9 of the drawings, in order to reconstruct the true beacon fix geometry, it is necessary to find scalars s and tv. A convenient way of doing this is to first perform a temporary rotation using a transform constructed from $BR\vec{v}1'$ so that $BR\vec{v}1'$ becomes the X axis of a temporary coordinate system. This is done by taking the triangle defined by vertices BP1', BP2' and the beacon B and rotating it into the X axis and translating P1 to the origin to give:

Equation 22 and 23

$$p1'' = [0 \quad 0] \quad \text{Equation 26}$$

$$p2'' = A*(BP2'_{(GCS)} - BP1'_{(GCS)}) \quad \text{Equation 27}$$

$$\text{where } \underset{A}{A} = \begin{pmatrix} BR\vec{v}1'_{(GCS).x} & BR\vec{v}1'_{(GCS).y} \\ -BR\vec{v}1'_{(GCS).y'} & BR\vec{v}1'_{(GCS).x'} \end{pmatrix} \quad \text{Equation 28}$$

In A above, v1' is the unit vector pointing to the beacon but rotated into the GCS i.e. $BRv1'_{(GCS)}$. It is also to be noted that there is a transposition of y and x between the rows in A.

To find s we already know p2" from above and $$v2'' = A * BR\vec{v}2' \quad \text{Equation 29}$$

so $$s = P2.x'' / \vec{v}2.x'' \quad \text{Equation 30}$$

$$tv = (s * \overrightarrow{v2}'_x + p1'_x - p2'_x) * \frac{1}{\overrightarrow{v1}_x} \quad \text{Equation 31}$$

However, because the segment has been translated to a temporary origin, i.e. p1"=[0 0], and $\vec{v}\,\mathbf{1}$ is rotated to the x axis, i.e. $\vec{v}\,\mathbf{1}$".x=1, tv can be simplified as follows:

$$tv = s * \overrightarrow{v2}''_x - p2''_x \quad \text{Equation 32}$$

Because, s, $\overrightarrow{v2}''_x$ and $p2''_x$ have already been calculated, tv can be determined.

A segment as defined by the minimum curvature algorithms is created using Equations 1 to 5 above to compare the survey data with the beacon fix to establish the systematic errors.

Figure 7:
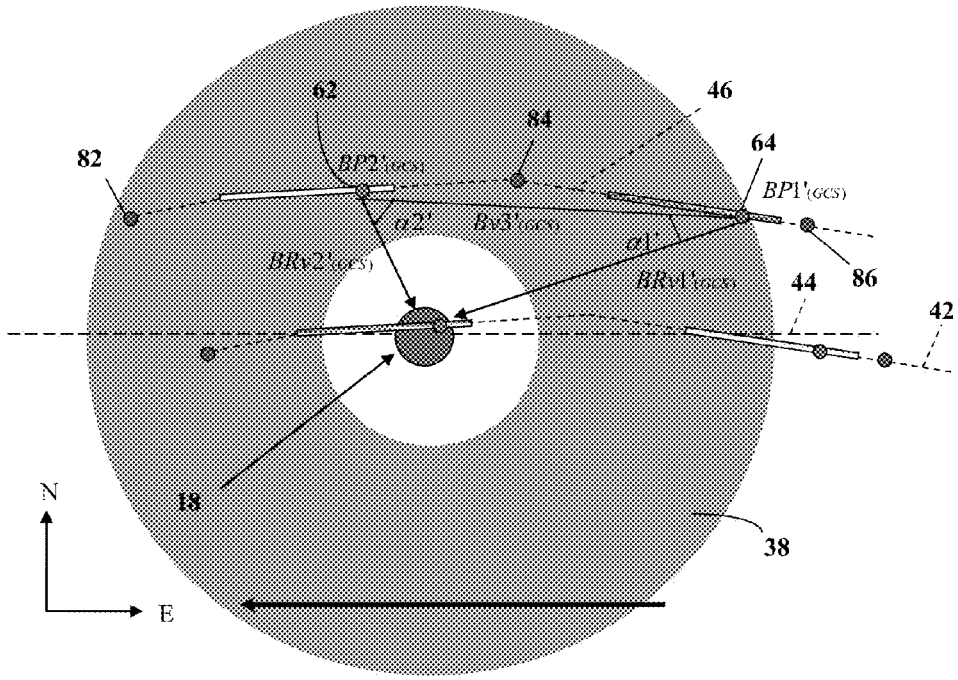
FIG. 7 shows a schematic plan view of part of the path with vectors used in the method superimposed thereon.
Figure 8:
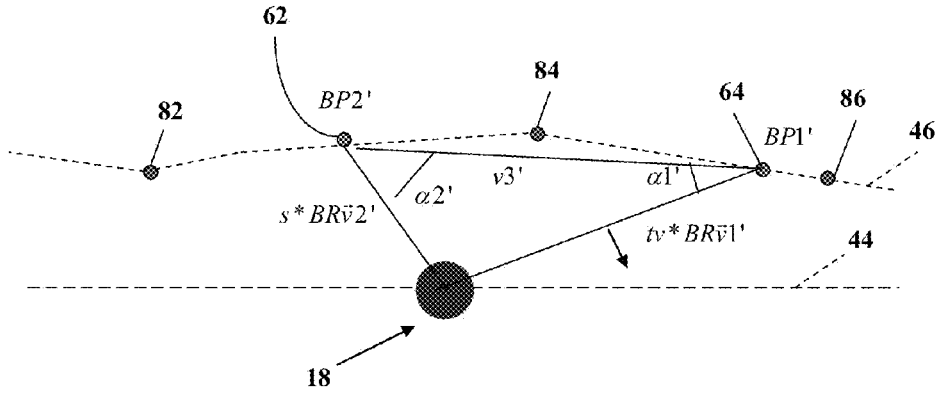
FIG. 8 shows a view similar to that of FIG. 7 with further information used in the method superimposed thereon.

In FIG. 7 of the drawings, the horizontal radial vectors $BRv1'_{(GCS)}$ and $BRv2'_{(GCS)}$ are $BRv1_{(SCS)}$ and $BRv2_{(SCS)}$ rotated or transformed to align with the grid coordinate system by an amount equal to the heading of the probe 20 in GCS but relative to the field generated by the beacon 18. In order to differentiate between survey measurements and beacon measurements below, the point or vector in question is prefixed with S and B respectively. Thus, for example, $BP2'_{(GCS)}$ is in GCS coordinates but relative to the beacon whereas $SP2'_{(GCS)}$ is in GCS coordinates but relative to the survey. It must also be borne in mind that the survey accumulates errors relative to the entry collar 40. Not shown in FIG. 7 are vectors $BRv1_{(SCS)}$ and $BRv2_{(SCS)}$ which point to the beacon from the raw survey sensor data but not fixed to the grid. $Bv3'_{(GCS)}$ is the straight path measured between P1 and P2 relative to the beacon 18.

Radial vectors $BRv1_{(SCS)}$ and $BRv2_{(SCS)}$ point to the beacon 18 with respect to the longitudinal axis of the probe 20. In FIG. 7, vectors $BRv1'_{(GCS)}$ and $BRv2'_{(GCS)}$ are transformed from $BRv1_{(SCS)}$ and $BRv2_{(SCS)}$. Vectors $BRv1_{(SCS)}$ and $BRv2_{(SCS)}$ are each individually rotated by the amount dictated by the azimuthal heading of the probe 20 in the horizontal plane. This rotates the vectors so they are pointing in a direction relative to the grid rather than to the probe 20 which itself could be pointing anywhere. Because of this, it is necessary to look at the geometry of the system 10 in terms of the fixed grid, i.e. it must be independent of the heading of the probe 20. If, for example, a beacon survey were taken at p1 and the probe's heading was 275 deg GCS and a heading of 265 deg GCS at P2 then this would clearly add a 10 degrees rotational discrepancy to $BRv2_{(SCS)}$ in addition to the change in angle due to the translation (displacement from one point to the next). Therefore, $$SRv3'_{(GCS)} = BP2'_{(GCS)} - BP1'_{(GCS)} \quad \text{Equation 33}$$

It is assumed that:

$$SRv3'_{(GCS)} = BRv3'_{(GCS)} \quad \text{Equation 34}$$

This is a reasonable assumption to make as the errors introduced by the survey have accumulated over a great distance but they will be insignificant over the small distance measured over a fix $v3'_{(SCS)} = Bv3'_{(SCS)}$ It is known in which directions $BRv1'_{(GCS)}$, $BRv2'_{(GCS)}$ and $v3_{(GCS)}$ are pointing in GCS. The processor 32 now needs to scale $BRv1'_{(GCS)}$, $BRv2'_{(GCS)}$ by the calculated scalars tv and s, respectively. Once the scalars have been applied and since the position of the target 14 is already known to a high degree of certainty in absolute GCS terms, it is possible to anchor the scaled vectors $-BRv1_{(GCS)}$ and $-BRv2_{(GCS)}$ to the target 14. Since the scaled vectors are pointing in exactly the opposite direction $-BRv1_{(GCS)}$ will point back to $Bp1'_{(GCS)}$ and $-BRv2_{(GCS)}$ will point back to $Bp2'_{(GCS)}$. To find $p1'_{(GCS)}$, it is necessary to translate the scaled vectors to the known beacon point and invert the scaled vectors to provide:

$$p1'_{(GCS)} = Bp_{(GCS)} - tv * BRv1_{(GCS)} \quad \text{Equation 35}$$

$$p2'_{(GCS)} = Bp_{(GCS)} - s * BRv2_{(GCS)} \quad \text{Equation 36}$$

where $p1'_{(GCS)}$, $p2'_{(GCS)}$ are the final recalculated positions; and $Bp_{(GCS)}$ are the target beacon coordinates in GCS In order to determine the difference in angle and position between the surveyed point and the ranged point, the processor 32 first calculates the centra of the beacon shot clusters and the centra of the equivalent survey point clusters. Angular error can be found by applying Equation 37 below. After the angular error correction has been applied to the trajectory, either by use of an appropriate transform or by simply adding the error to the azimuth parameter, both beacon shots and survey shots should line up in angle but not necessarily in baseline displacement. Displacement is calculated by simply subtracting as shown in Equation 38 below.

$$\Delta\text{Angle} = \tan^{-1}\left(B\frac{1}{n}\sum_{l=1}^{n} a_l - S\frac{1}{n}\sum_{l=1}^{n} a_l\right) \quad \text{Equation 37}$$

where B indicates the cluster of beacon shots and S indicates the cluster of equivalent survey derived shots at the same location.

$$\Delta\text{Displacement} = CSpt2' - CBpt1' \quad \text{Equation 38}$$

where

CS is the centrum point of the cluster of survey derived shots; and

CB is the centrum point of the cluster of beacon shots.

Once the angular error and the baseline displacement error have been calculated, the processor 32 re-calculates the trajectory 46 which the drill string 22 is now to follow. Thus, once the new trajectory 46 has been calculated, the drill string 22 is withdrawn along the lateral hole 12 towards the entry collar 40. The processor 32 indicates to what position the drill string 22 must be withdrawn. This is communicated to the operator in a discernible manner, for example, by the use of a lighting arrangement. A red light indicates that the drill string 22 needs to be withdrawn and the light remains red until the new pull back position has been reached. At this position, the light turns green indicating that drilling along the new trajectory 46 can commence.

It is therefore an advantage of the invention that only one pass of the target borehole 14 needs be made by the drill string 22. Once the errors have been calculated, the second trajectory should result in an intersection of the borehole 14. This considerably reduces the amount of time and effort required to intersect the borehole 14 as, in the past, numerous approaches to a borehole have needed to be made in order, eventually, to intersect the target. Thus, the cost of intersecting the target using the system 10 is considerably reduced. This has major cost benefits and time benefits for an operator of the drill string 22.

Additionally, the system 10 is simple to operate as movement of the magnetic beacon is not required in order to develop an adjusted trajectory. The system 10 is largely implemented in software so no hardware modifications need be made to existing drill strings 22. Once again, this has resultant cost benefits.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of guiding a probe to a target, the method including placing a magnetic field generator at the target;

guiding the probe to a region of the target, the probe carrying a survey sensor pack;

using the survey sensor pack to obtain a plurality of survey readings of a shape of a path of the probe relative to the target and a distance between readings of the survey sensor pack;

using the survey sensor pack to obtain a plurality of magnetic beacon readings using a magnetic field generated by the magnetic field generator to determine a position of the path of the probe relative to, and past, the target;

comparing a selected number of the survey readings in proximity to the target with a corresponding number of the magnetic beacon readings and determining a difference between each survey reading and its associated magnetic beacon reading to determine a spacing of the path of the probe at the position of the probe past the target; and withdrawing the probe to a position upstream of the target, compensating for that spacing and repositioning the probe so that, on a further pass of the probe towards the target, the probe is placed on a corrected path to intersect the target.

2. The method of claim 1 which includes taking a predetermined number of magnetic beacon readings when the probe is within range of the magnetic field generator.

3. The method of claim 2 which includes deriving fixes from at least two pairs of predetermined magnetic beacon readings.

4. The method of claim 3 which includes selecting each magnetic beacon reading for use in deriving the fixes by comparing the magnetic beacon reading with a corresponding survey reading and, if the magnetic beacon reading differs from the survey reading by an amount exceeding a predetermined value, disregarding that magnetic beacon reading.

5. The method of claim 3 which includes forming a segment of magnetic beacon readings from the fixes.

6. The method of claim 5 which includes comparing the segment of magnetic beacon readings with a segment of corresponding survey readings.

7. The method of claim 2 which includes taking two measurements for each magnetic beacon reading, one with poles of the magnetic field generator in a first orientation and the other with the poles of the magnetic field generator in an opposite orientation to minimise the effects of earth's magnetic field.

8. The method of claim 2 which includes obtaining a vector representative of a radial component of the magnetic field generated by the magnetic field generator at each magnetic beacon reading.

9. The method of claim 8 which includes transforming raw vectors from each magnetic beacon reading to obtain the radial component.

10. The method of claim 1 which includes selecting the magnetic field generator to be of predetermined dimensions.

11. The method of claim 10 which includes selecting the dimensions of the magnetic field generator in dependence of the distance it is estimated the probe is likely to be from the target.

12. The method of claim 1 which includes initially defining a commencement position and termination position for the probe.

13. The method of claim 12 which includes excluding data relating to non-completed, unusable portions of the initial trajectory.

14. The method of claim 1 which includes implementing the magnetic field generator in segments so that a magnetic field generator of desired length can be used.

15. The method of claim 1 which includes processing and recording data generated by the probe along its initial trajectory.

16. The method of claim 1 which includes calculating an angular difference between each magnetic beacon reading and its associated survey reading and calculating a difference in displacement between the magnetic beacon reading and its associated survey reading.

17. The method of claim 1 which includes calculating a new trajectory and displaying the new trajectory to an operator.

18. A system for guiding a probe to a target, the system including a magnetic field generator to be located at the target;

a survey probe to be guided to the target, the survey probe carrying a survey sensor pack, sensors of the sensor pack being operable to obtain a plurality of survey readings of a shape of a path of the probe relative to the target and a distance between the readings of the survey sensor pack and a plurality of magnetic beacon readings using a magnetic field generated by the magnetic field generator to determine a position of the path of the probe relative to, and past, the target; and processing equipment responsive to the survey sensor pack for processing data to compare a selected number of the measured survey readings in proximity to the target with a corresponding number of the magnetic beacon readings to determine a difference between each survey reading and its associated magnetic beacon readings to determine a spacing of the path of the probe at the position of the probe past the target and for compensating for that spacing, the processing equipment being operable, when the probe has been withdrawn to a position upstream of the target, to reposition the probe so that, on a further pass of the probe towards the target, the probe is placed on a corrected path to intersect the target.

19. The system of claim 18 in which the survey pack is operable to take a predetermined number of magnetic beacon readings when the probe is within range of the magnetic field generator.

20. The system of claim 19 in which the processing equipment is operable to derive fixes from at least two pairs of predetermined magnetic beacon readings.

21. The system of claim 20 in which the processing equipment is operable to select each magnetic beacon reading for use in deriving the fixes by comparing the magnetic beacon reading with a corresponding survey reading and, if the magnetic beacon reading differs from the survey reading by an amount exceeding a predetermined value, disregarding that magnetic beacon reading.

22. The system of claim 21 in which the processing equipment is operable to form a segment of magnetic beacon readings from the fixes and to compare the segment of magnetic beacon readings with a segment of corresponding survey readings.

23. The system of claim 18 in which the magnetic field generator has variable dimensions, the dimensions of the magnetic field generator being selected in dependence of the distance it is estimated the probe is likely to be from the target.

24. The system of claim 23 in which the magnetic field generator comprises a plurality of interconnectable segments so that a magnetic field generator of desired length can be used.

25. The system of claim 23 in which the magnetic field generator is a solenoid having switchable poles.

26. The system of claim 18 in which the processing equipment is operable to obtain a vector representative of a radial component of the magnetic field generated by the magnetic field generator at each magnetic beacon reading.

27. The system of claim 26 in which the processing equipment is operable to transform raw vectors from each magnetic beacon reading to obtain the radial component.

28. The system of claim 18 in which the processing equipment is operable to calculate a new trajectory for the probe.

29. The system of claim 28 which includes a display arrangement for displaying the new trajectory of the probe to an operator.

30. The system of claim 18 in which the survey sensor pack comprises a plurality of magnetometer/accelerometer pairs, the pairs being arranged to take the readings along Cartesian coordinates.

31. The system of claim 18 in which the processing equipment is operable to process and record data generated by the probe along its initial trajectory.

32. The system of claim 18 which includes a switching arrangement for switching the relative orientation of poles of the magnetic field generator to minimise the effects of earth's magnetic field.

33. The system of claim 18 in which the processing equipment is operable to calculate an angular difference between each magnetic beacon reading and its associated survey reading and to calculate a difference in displacement between the magnetic beacon reading and its associated survey reading.

* * * * *